US005449165A

United States Patent [19]

Naramore

[11] Patent Number: 5,449,165

[45] Date of Patent: Sep. 12, 1995

[54] 90 DEGREE PAPER FEED TRANSITION MODULE

[75] Inventor: Raymond A. Naramore, Webster, N.Y.

[73] Assignee: Xerox Corporation, Stamford, Conn.

[21] Appl. No.: 51,907

[22] Filed: Apr. 26, 1993

[51] Int. Cl.[6] ..... B65H 5/00

[52] U.S. Cl. ..... 271/225; 271/184

[58] Field of Search ..... 271/225, 245, 226, 248, 271/272, 184, 188

[56] References Cited

U.S. PATENT DOCUMENTS

| | | | |
|---|---|---|---|
| 1,745,311 | 1/1930 | Olson et al. . | |
| 1,889,513 | 11/1932 | Broadmeyer . | |
| 2,249,186 | 7/1941 | Spiess . | |
| 3,630,518 | 12/1971 | Street et al. . | |
| 4,106,767 | 8/1978 | Schirrmeister et al. | 271/188 |
| 5,004,220 | 4/1991 | Dreschel et al. | 271/225 X |

FOREIGN PATENT DOCUMENTS

| | | | |
|---|---|---|---|
| 346956 | 2/1991 | Japan | 271/225 |
| 3120148 | 5/1991 | Japan | 271/184 |

*Primary Examiner*—David R. Bollinger
*Attorney, Agent, or Firm*—William A. Henry, II

[57] ABSTRACT

A transition module adapted to accept copy sheet input from an input feeder short edge first and feed the copy sheets long edge first to the main paper path of a processing apparatus. The transition module includes a belt-on-belt transport to move copy sheets into the transition module from, for example, the output of a third party feeder. The sheets are fed to the belt-on-belt transport and driven against a registration edge. The belts are continuously running and provide enough drive force to move the sheets to the registration edge, but not enough to overdrive the sheets or cause buckling. Once each sheet is registered, double 'D' rolls are activated for one revolution to pull the sheet from the belts and feed it to an exit nip located downstream from the 'D' rolls.

20 Claims, 9 Drawing Sheets

90 DEGREE PAPER FEED TRANSITION MODULE

BACKGROUND OF THE INVENTION

This invention relates to a sheet transport apparatus, and more particularly, to a compact transition module for transporting sheets in one direction and including simple means for changing the direction of movement of the sheets to feed them in another direction.

Prior sheet transport mechanisms for moving a sheet in a first direction and then moving it in a second direction without rotation of the sheet conventionally utilize two separate transport mechanisms orthogonal to each other, such as, two separate sets of feed belts or frictionally driven rotating balls. For example, a sheet is moved by the first set of belts or balls into the second set. However, this requires two separate sheet handling areas, and drive mechanisms and shifting of the sheet by some means from the one transport to the other. Examples of previously known bi-directional sheet transports, or driven ball sheet transports includes U.S. Pat. Nos. 1,745,311; 1,889,513; 2,249,186 and 3,630,518. These devices are expensive, cumbersome and not suited for high speed, high capacity applications.

OBJECTS AND SUMMARY OF THE INVENTION

It is an object of the present invention to provide a cost effective input transitional module that enables a variety of high capacity feeding devices to connect to a laser printing system or the like.

It is another object of the present invention to provide a transition module that accepts copy sheets inputted from a third party piece of equipment and feed the copy sheets to the main paper path of an imaging system.

It is a further object of the present invention to provide a low cost, transition module that accepts copy sheets from a first piece of equipment short edge first and registers them and re-feeds them long edge first at high speed to another piece of equipment that places page image information onto the copy sheets and transports them to an output stacking apparatus.

To achieve the aforegoing and other objects, and to overcome shortcomings discussed above, a copy sheet input transition module is provided which is positioned between or separates an ultra-high capacity copy sheet feeding device from an image processor. As a copy sheet enters the transition module, it is driven (short edge as the lead edge) by a belt-on-belt system to a registration wall. Once registered, the sheet is driven out of the transition module (long edge as the lead edge) into the image processor by a 'D'-on-'D' elastomeric drive roll system. Simultaneously, as the sheet enters the image process, the next copy sheet enters the transition module. An overlap or shingling baffle, located between the drive belts, lifts this copy sheet off the lower drive belt, allowing this copy sheet to partially overlap the copy sheet being driven out by the 'D'-on-'D' roll system, creating a timing buffer for the transition module.

BRIEF DESCRIPTION OF THE DRAWINGS

The invention will be described in detail with reference to the following drawings in which like reference numerals refer to like elements and wherein.

DETAILED DESCRIPTION OF THE PREFERRED EMBODIMENT

Figure 1:
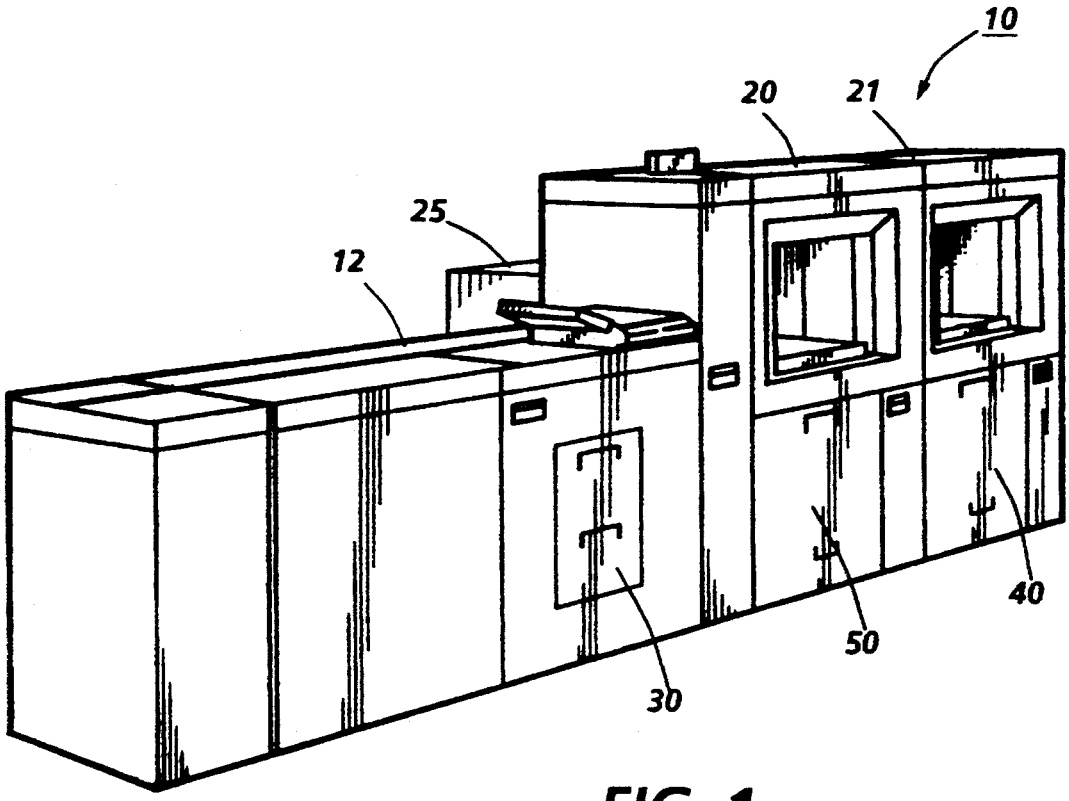
FIG. 1 is an isometric view of a printing system which incorporates a transition module according to the present invention.

FIG. 1 illustrates a feeder/stacker 10 which includes a transition module 50 according to the present invention located beneath disc stacker 20. A second disc stacker 21 is adjacent disc stacker 20 and located beneath it are a high capacity feeder 40. Imaging and feeder portion 12 can be, for example, a high speed copier or printer, such as, U.S. Pat. No. 5,114,135 or the Xerox ®4135 Laser Printing System, both of which is incorporated herein by reference to the extend necessary to practice the present invention. One type of system usable as imaging and feeder portion 12 can include copy sheet input feeders 30 and an optical scanner for digitizing data contained on original documents and supplying the digitized data to a high speed, high quality printer, such as a laser printer which outputs documents to disc stackers 20 and 21.

Figure 2:
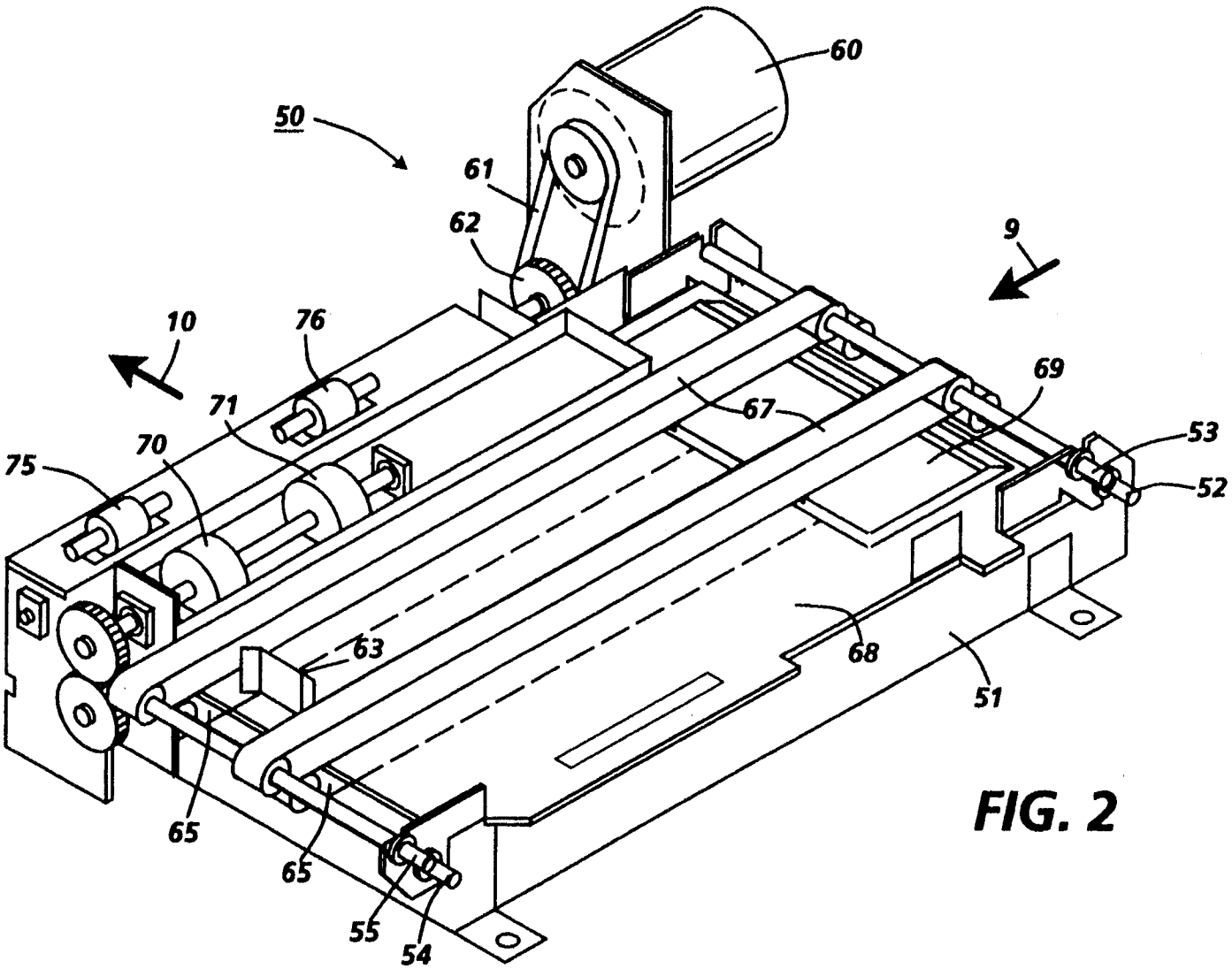
FIG. 2 is a partial isometric view of the transition module incorporated in the printing system of FIG. 1.

FIG. 2 illustrates the basic components of input transition module 50. Transition module 50 is adapted to receive copy sheets from conventional ultra-high speed feeder 25 in the direction of arrow 9 with each sheet being fed short edge first and drive each copy sheet individually and separately therefrom orthogonal to the incoming direction and in the direction of arrow 10 long edge first. High speed feeder 25 could be either cut sheet or roll fed as long as requisite feed speeds are maintained. Support 51 has shafts 52, 53, 54 and 55 mounted thereon for clockwise rotation by an AC motor (not shown) and conventional gearing (not shown). Lower copy sheet drive belts 65 entrained around shafts 52 and 55 and upper drive belts 67 entrained around rotatable shafts 53 and 54 drive copy sheets onto copy sheet support baffle 68. En route to support baffle 68, each copy sheet is driven by the belts 65 and 67 over a manually adjustable overlap ramp baffle 69 so that once a copy sheet is past baffle 69 the copy sheet will fall onto support baffle 68 and rest in a horizontal plane that is beneath a horizontal plane along the top surface of ramp baffle 69. Adjustable ramp 69 is adjusted by use of a convention handle/lever mechanism (not shown) that slides the ramp left or right as viewed in FIG. 2 depending on whether an $8\frac{1}{2}\times 11$ or $8\frac{1}{2}\times 14$ inch or any other size copy sheet is being fed into the transition module. However, it should be understood that ramp 69 could be made to automatically adjust to different size copy sheets, if desired.

Figure 3:
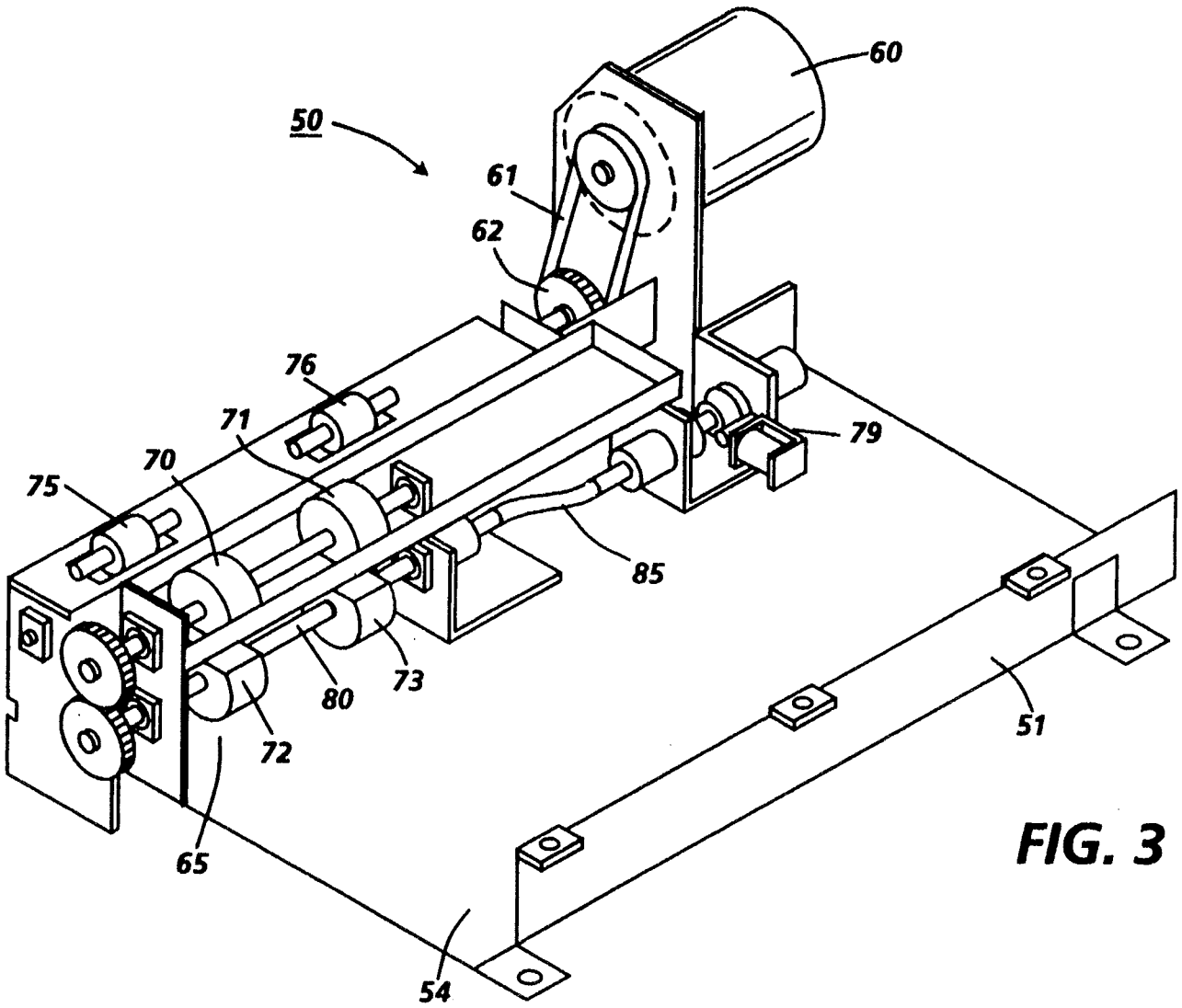
FIG. 3 is a partial isometric view of the transition module of FIG. 2 with the copy sheet support baffle and overlap ramp baffle removed for clarity.

A registration wall 63 along with the rotating belts registers each copy sheet and afterwards, upper 'D' rolls 70 and 71 and lower 'D' rolls 72 and 73 which are shown more clearly in FIG. 3, which has support baffle 68 and overlap ramp baffle 69 removed for clarity, are adapted to feed each copy sheet individually from support baffle 68 into nips formed between two idler rolls 75 and 76 and take-away rolls (not shown) and into copy sheet transport drives of imaging and feeder portion 12 of feeder/stacker 10. An exit drive motor 60 through belt 61 and pulley 62 drives the take-away rolls.

Figure 4:
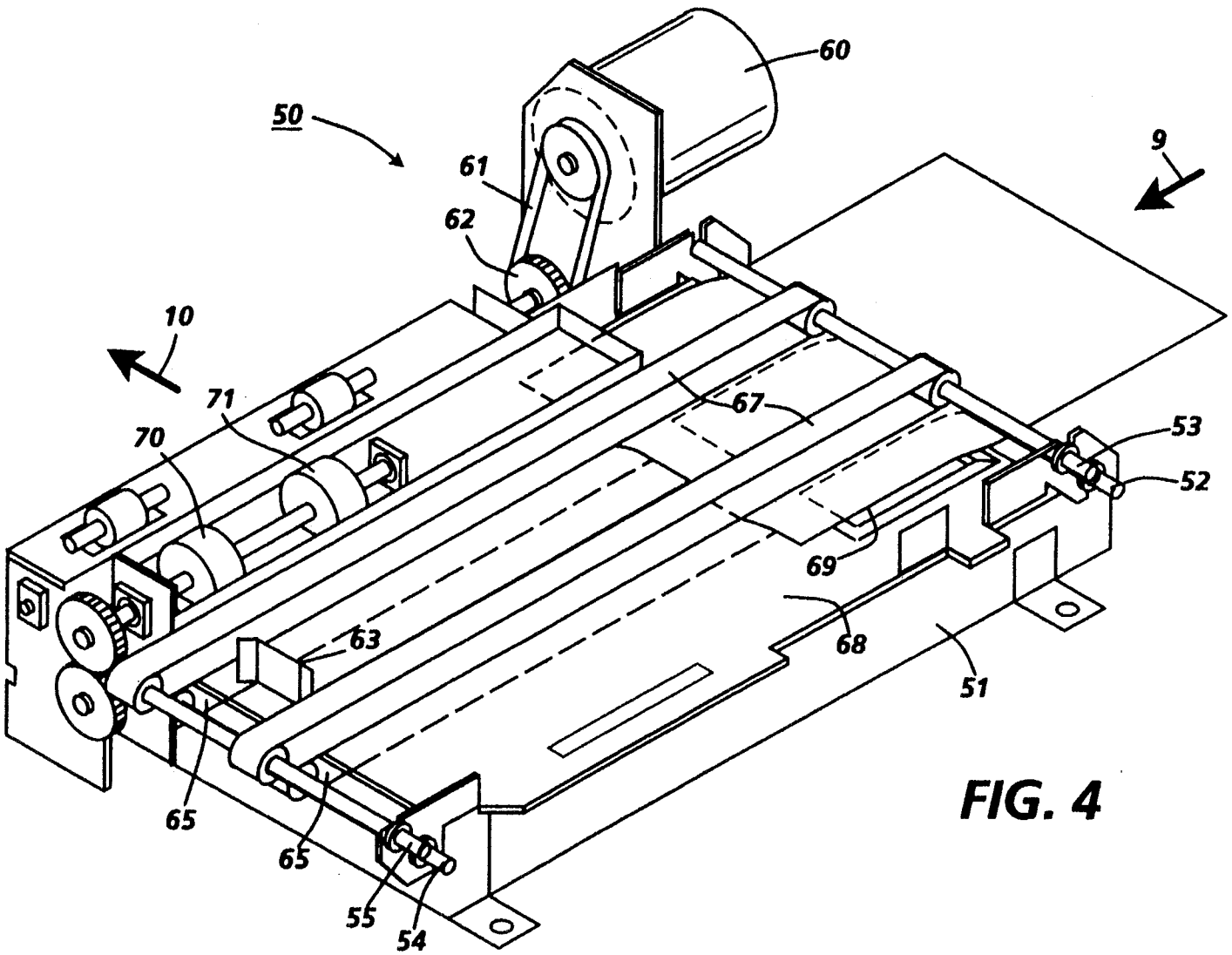
FIG. 4 is a partial isometric view of the transition module of FIG. 2 showing an initial copy sheet entering the transition module and driven forward by a belt-on-belt transport.
Figure 5:
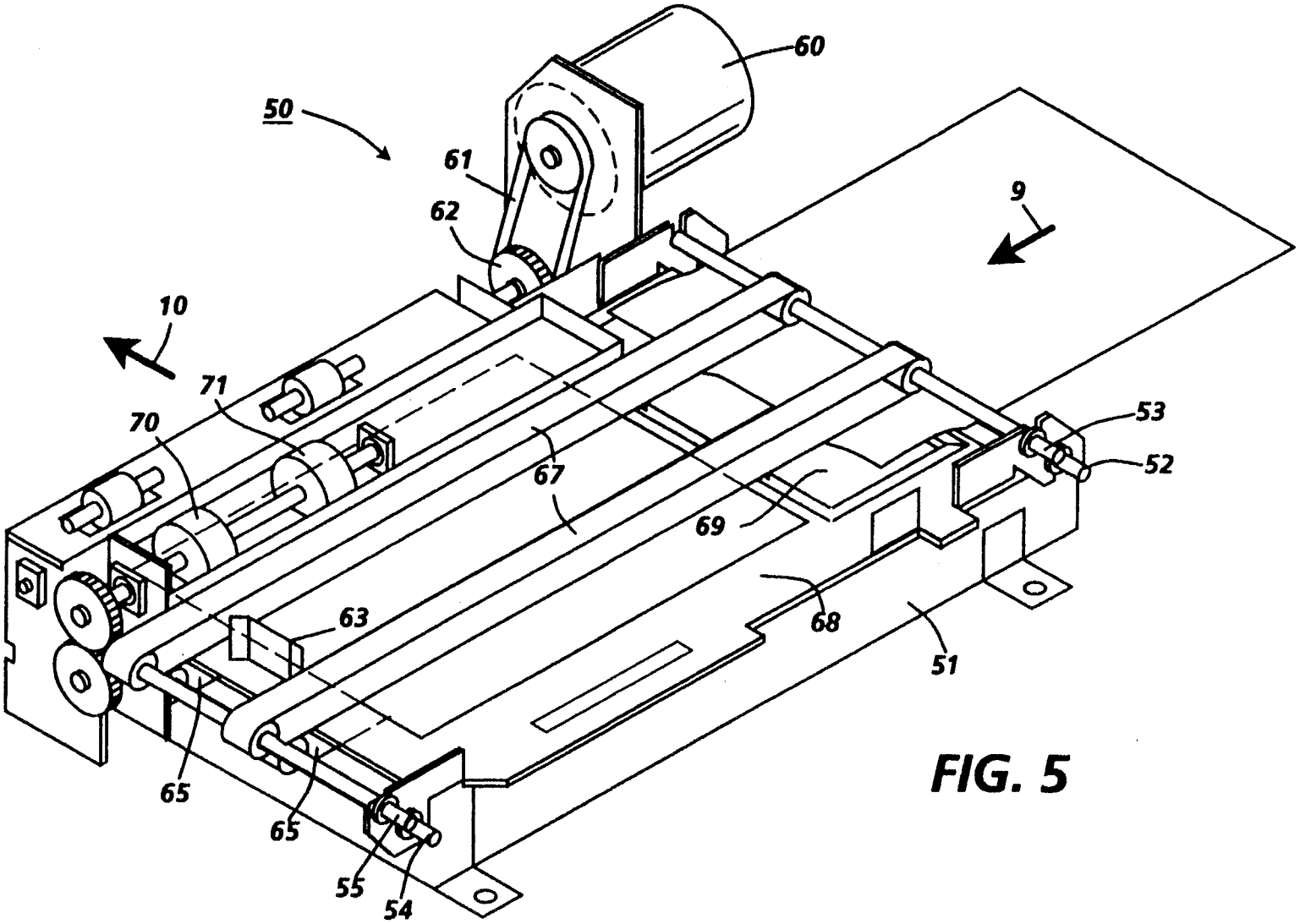
FIG. 5 is a partial isometric view of the transition module of FIG. 2 showing an initial copy sheet contacting a registration wall as a second copy sheet enters the transition module.
Figure 6:
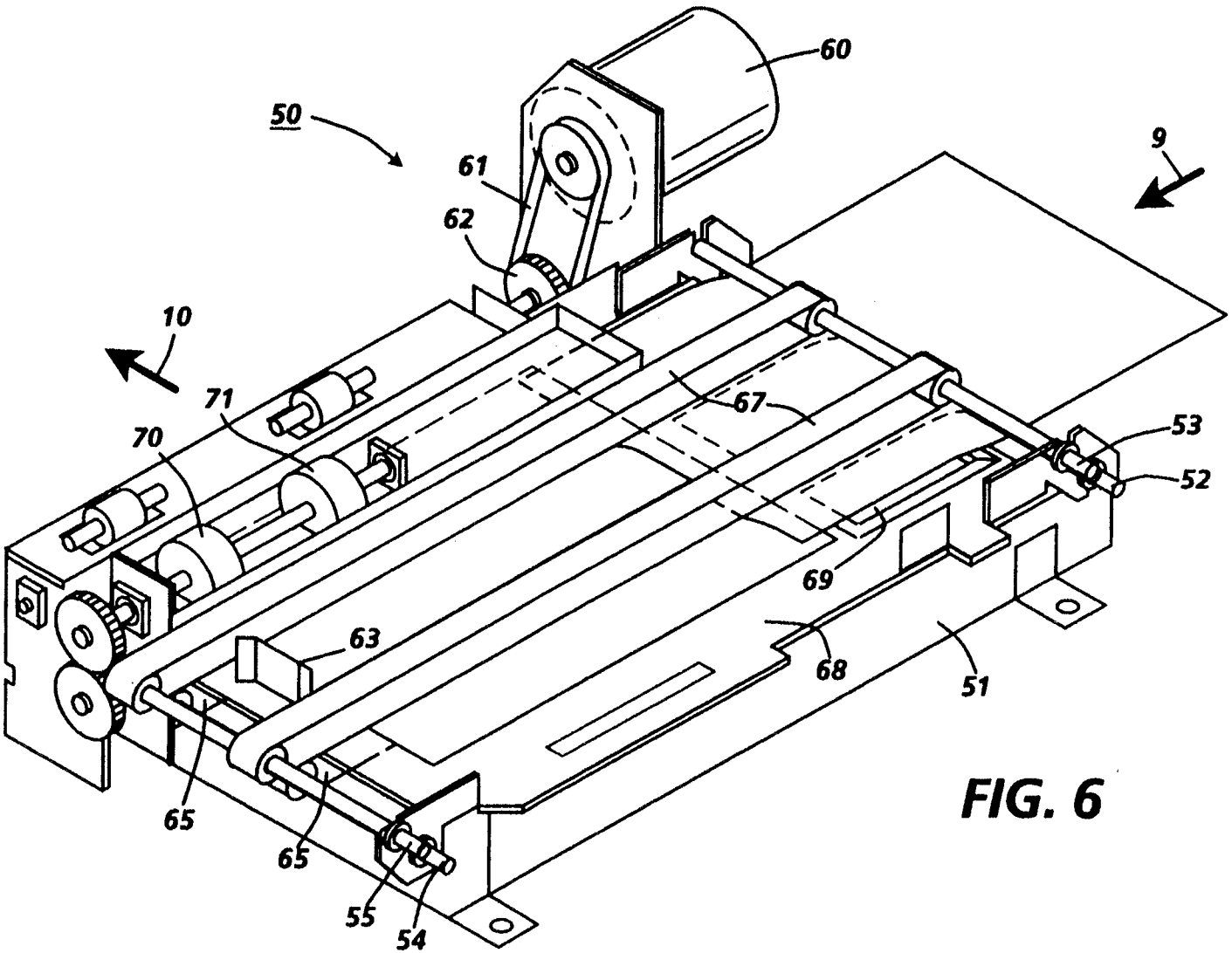
FIG. 6 is a partial isometric view of the transition module of FIG. 2 showing an initial copy sheet scuffed against a registration wall as a second copy sheet overlaps the initial copy sheet.

In operation and as shown in FIGS. 1–4, once a copy sheet request signal is given to high speed feeder 25, a single copy sheet (sheet 1) is fed into transition module 50. The copy sheet is received and driven by the continuously running belt-on-belt transport comprising belts 65 and 67 that are driven by an AC motor. The overlap ramp baffle 69 (which is adjustable for various copy sheet sizes), located between the belts, lifts the sheet off the lower belt 65. The sheet is now driven against registration wall 63 by the differential in friction coefficient between the upper belt 67 and the overlap baffle. The nip (drive) force developed on the sheet is due to the corrugation, by the upper belt 67, between the overlap baffle openings as shown in FIG. 4. The sheet continues to be driven by the upper belt and as the trail edge of the sheet passes across the front edge of the overlap ramp baffle, the upper belt is allowed to drop down about 6 mm with the sheet now being driven by nip force created between the upper and lower belts. The lead edge of the sheet is then driven into a registration wall 63. The belt-on-belt transport scuffs the sheet against the registration wall 63, which deskews the sheet. A second (sheet 2) copy sheet is fed into the transition module as sheet 1 is registered against registration wall 63 as shown in FIGS. 5–6 and is driven across the front edge of the overlap baffle, the lead edge is now about 6 mm above the lower belt, and may overlap sheet 1 which is registered against the registration wall, waiting for the 'D' rolls to be energized.

Figure 7:
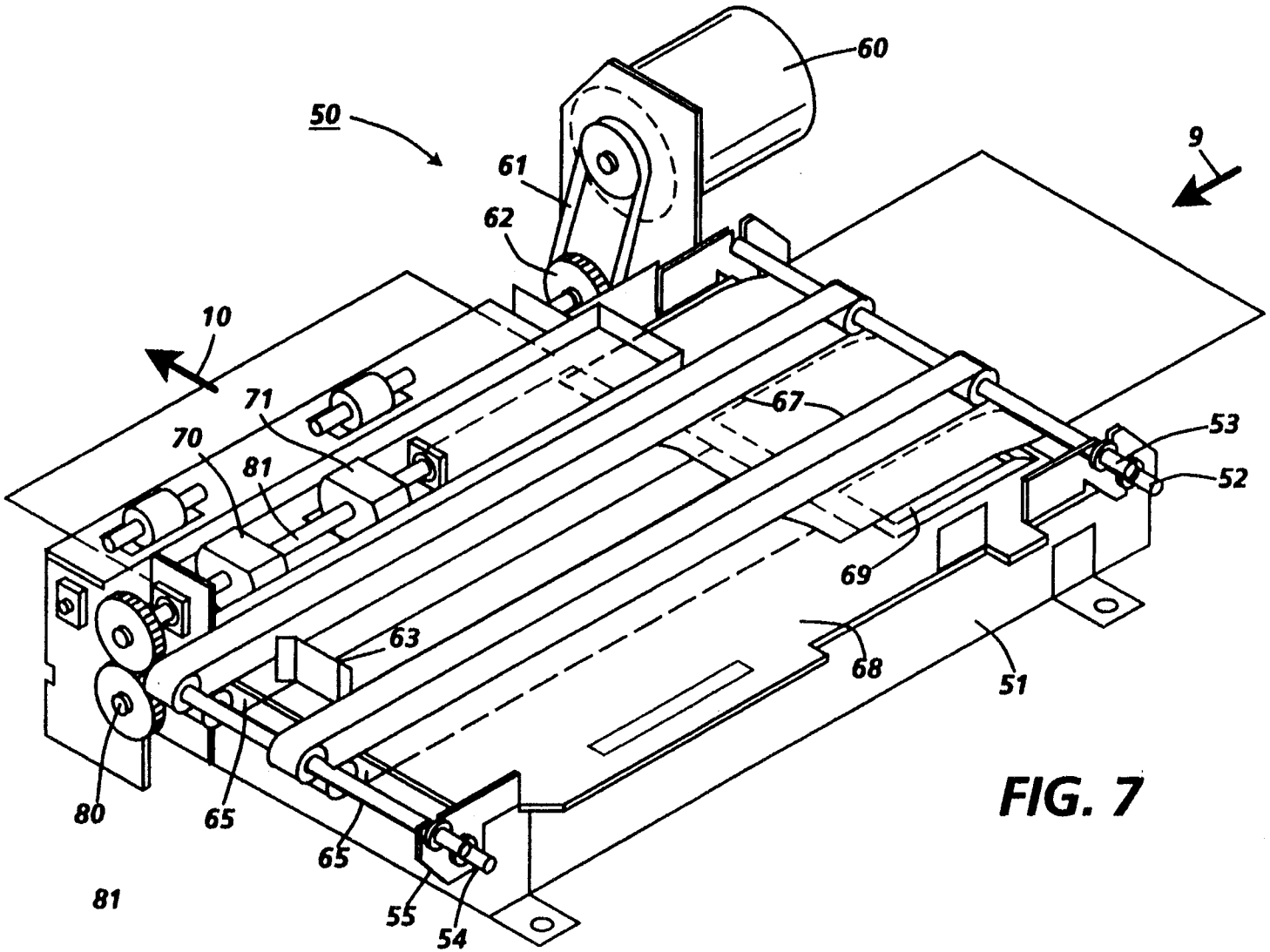
FIG. 7 is a partial isometric view of the transition module of FIG. 2 showing an initial copy sheet being fed out of the transition module while a second copy sheet is being driven into the transition module.
Figure 8:
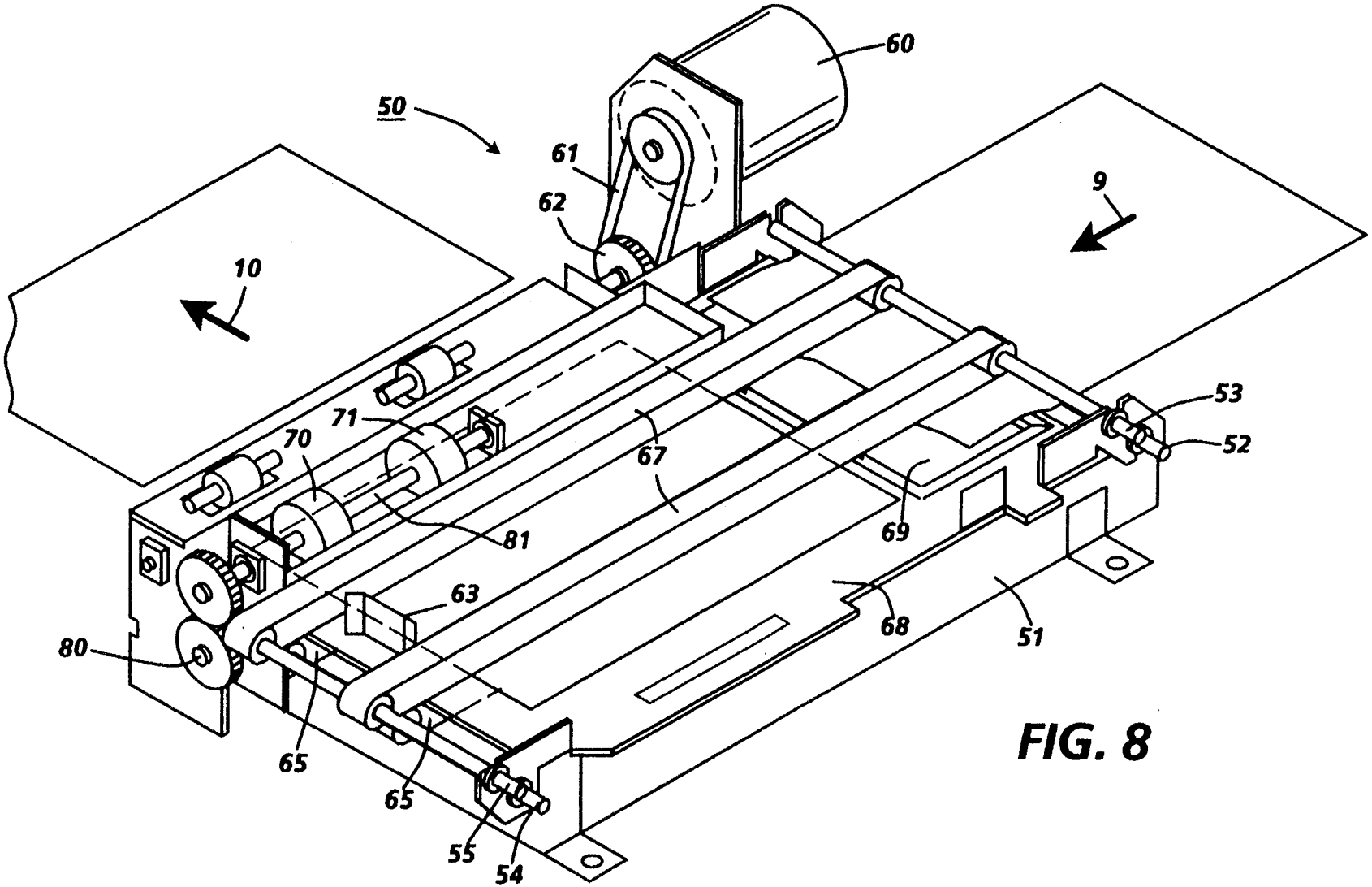
FIG. 8 is a partial isometric view of the transition module of FIG. 2 showing one copy sheet having been driven out of the transition module while a second copy sheet is scuffed against a registration wall and a third copy sheet is being driven into the transition module.

As shown in FIGS. 3, 7 and 8, translation of sheet 1 occurs 540 msec after the feed signal is given to high speed input feeder 25 through a 360° wrap spring clutch 79 that is energized which activates the 'D' rolls 70, 71, 72 and 73 through flexible shaft 85. This feed system consists of an upper shaft 81 and lower shaft 80 with two elastomeric 'D' rolls on each shaft. The 'D' roll configuration allows a gap to be created between the rolls (when entering in the direction of arrow 9). This gap allows each sheet to be transported between the rolls, and then registered against the registration wall. A flexible shaft 85 is used to connect the clutch 79 to the lower feed roll. The flexible shaft allows mechanical clearance between the clutch and a sheet as seen in FIG. 3. The upper feed rolls 70,71 are driven off the lower feed rolls 72,73. As the clutch is energized, the upper and lower rolls begin to rotate in opposite directions. A mechanical interference between the upper 70,71 and lower 72,73 rolls creates drive nips. Continuously running belts 65 and 67 keep the sheet registered as the nips are initially created. Once the nips are created, the feed rolls continue to rotate, driving the sheet to take-away rolls downstream from the nips. As the 'D' rolls 70–73 continue to rotate, the nips become disengaged. At this time, the take-away rolls drive the sheet into imager/-feeder 12. The 'D' rolls continue to rotate until a full 360° motion has been completed. Once the 'D' rolls 70–73 are back in their home position, the gap between the rolls allows the following sheet to be transported up to, and against, the registration wall.

Figure 9:
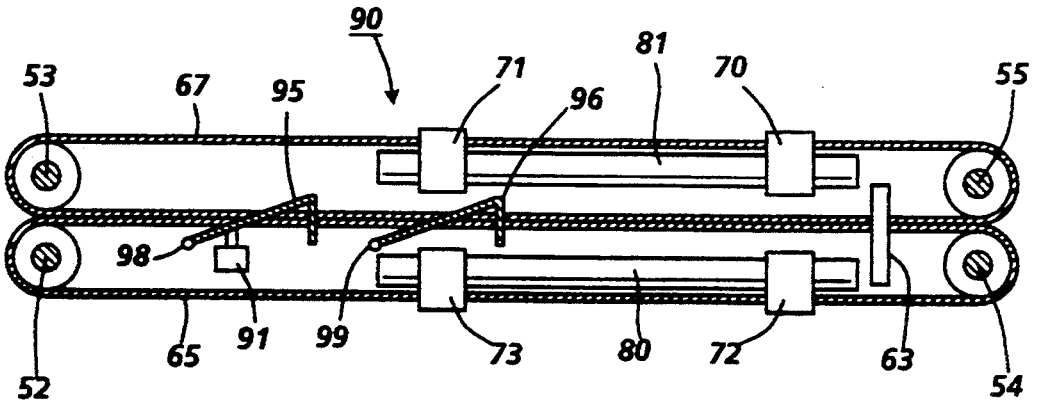
FIG. 9 is a partial, schematic side view of another embodiment of the transition module of the present invention employing trail edge ramps.
Figure 10:
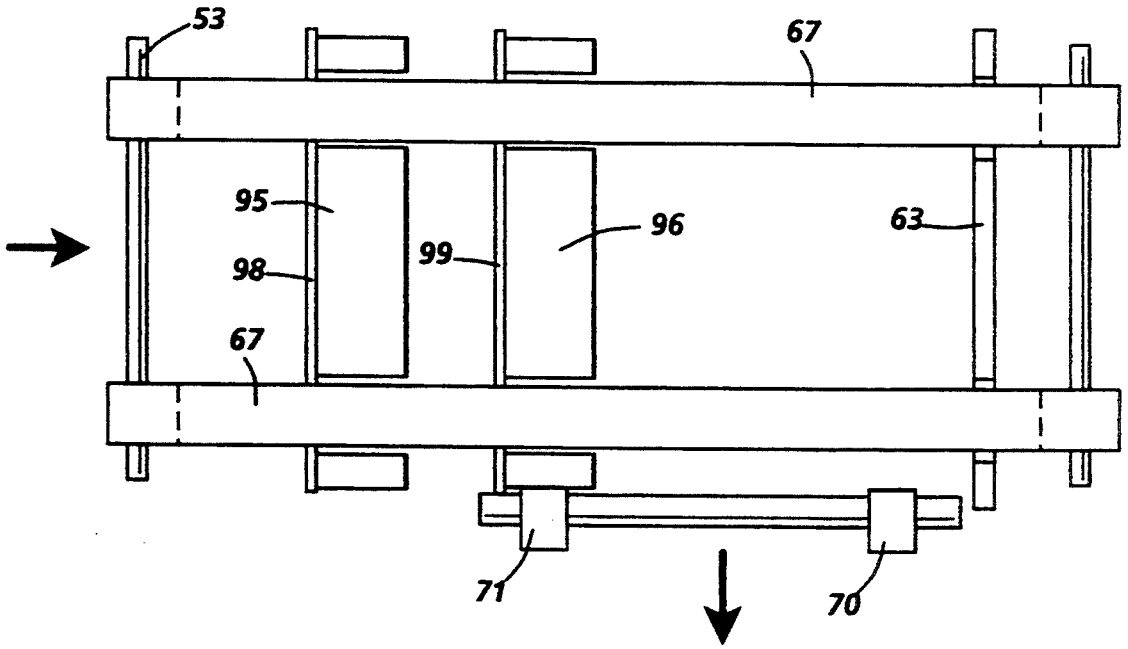
FIG. 10 is a partial, schematic plan view of the transition module of FIG. 9 with an arrow indicating the input direction of copy sheets from an input device and an arrow showing the output direction of copy sheets leaving the transition module.

Alternatively, as shown in FIGS. 9 and 10, a copy sheet transition module 90 includes a transport of belt 67 on belt 65 to move copy sheets into transition module 90 from the output of ultra-high speed copy sheet feeder 25 with each sheet being fed short edge first into the transition module and against registration edge 63. The belts are continuously running and provide enough drive force to move copy sheets to the registration edge 63, but not enough to overdrive the sheets or cause buckling. Once a sheet is registered against registration edge 63 by the belts, double 'D' rolls 70, 71, 72 and 73 are turned ON for one revolution to thereby pull the sheet from the belts and feed it to an exit nip located downstream of the 'D' rolls. Ramps 95 and 96 are located in the sheet path (except in the area of the belts) in order to lift a sheet as it passes thereover, forcing upper belt 67 to lift also thereby corrugating the sheet. Once the trail edge of the sheet passes over a selected ramp, the upper belt forces the sheet flat against the lower belt 65 again. These ramps cause the lead edge of the next sheet entering the transport to pass over the trail edge of the previous sheet allowing overlapping of sheets to occur which is necessary to meet the timing requirements of the system. Two adjustable ramps 95 and 96 are shown that pivot about shafts 98 and 99. The ramps can be pivoted by any conventional means, such as, solenoid 91. If $8\frac{1}{2}\times 11''$ copy sheets are coming into transition module 90, solenoid 91 is actuated to pull ramp 95 away from the path of the copy sheets. However, if $8\frac{1}{2}\times 14''$ copy sheets are coming into the transition module, a solenoid (not shown) is actuated to pull ramp 96 out of the path of the sheets.

It should now be understood that a low cost transition module is disclosed that is to be positioned between a third party copy sheet input device and an image processor with the transition module being adapted to receive sheets from the input device with the short edge as the lead edge and feed the sheets into the processor in a direction 90° away from the input direction with the long edge as the lead edge. A belt-on-belt transport is used to drive sheets into a registration edge and D-shaped feed rolls are to drive the sheets into take-away-rolls for transport out of the transition module.

What is claimed is:

1. A sheet transition module positioned with respect to a first and second device for moving sheets received from the first device to the second device, comprising:

a sheet support surface;

a non-adjustable, fixedly positioned registration edge positioned at a rear edge of said sheet support surface for registering sheets individually;

a fixedly positioned sheet transport for transporting the sheets received from the first device into said fixedly positioned registration edge; and fixedly positioned feed rolls activated for one revolution after each sheet is registered against said registration edge in order to feed each sheet into the second device.

2. The transition module of claim 1, wherein said sheet transport is a belt-on-belt transport.

3. The transition module of claim 2, wherein said belt-on-belt transport is continuously running during the sheet transport process.

4. The transition module of claim 3, wherein feed rolls are 'D' shaped.

5. The transition module of claim 4, wherein each sheet transported by said belt-on-belt transport passes between an opening between said 'D' rolls when said 'D' rolls are in a home position.

6. The transition module of claim 2, including at least one baffle encountered by each sheet as it is driven by said belt-on-belt transport.

7. The transition module of claim 6, wherein said at least one baffle is ramp shaped with the maximum height of the ramp being terminated by an end portion positioned downstream of a direction of transport of the sheets by said belt-on-belt transport.

8. The transition module of claim 7, wherein a sheet resting on said sheet support surface has a trail edge thereof abutting against said end portion of said ramp.

9. The transition module of claim 8, wherein one sheet is being driven out of said transition module by said 'D' rolls while another sheet is simultaneously being driven into said transition module by said belt-on-belt transport.

10. The transition module of claim 1, wherein a sheet is fed into said transition module in a first direction and fed out of said transition module in a second direction orthogonal to said first direction.

11. The transition module of claim 1, wherein each sheet enters said transition module short edge first and exits said transition module long edge first.

12. The transition module of claim 1, including means for buffering sheets within said transition module.

13. The transition module of claim 12, wherein said means for buffering sheets includes at least one ramp which lifts a second sheet entering said transition module over a first sheet resting on said sheet support surface.

14. The transition module of claim 12, wherein said at least one ramp is pivotably mounted for pivoting orthogonal to the direction of movement of copy sheets coming into said transition module.

15. A copier/printer adapted to place page image information onto copy sheets fed to the copier/printer from a high speed feeder including a transition module adapted to receive copy sheets from the high speed feeder and feed the copy sheets into the copier/printer, said transition module comprising:

means for receiving copy sheets individually from the high speed feeder through a first path;

means for driving each copy sheet out of said transition module through a second path and into the copier/printer; and wherein said transition module includes means for feeding one copy sheet into the copier/printer while simultaneously receiving a second copy sheet on top of the copy sheet being fed.

16. The copier/printer of claim 15, wherein said transition module is adapted to receive the copy sheet short edge first in said first path and drive the copy sheet into the copier/printer long edge first through said second path.

17. The copier/printer of claim 16, wherein said copy sheet being fed long edge first from said transition module is overlapped by a copy sheet coming into said transition module short edge first.

18. The copier/printer of claim 15, including means for ensuring that the copy sheet coming into said transition module is positioned above the copy sheet being fed into the copier/printer.

19. The copier/printer of claim 18, wherein said means for ensuring that the copy sheet coming into said transition module is positioned above the copy sheet being fed into the copier/printer is a ramp.

20. A sheet transition module positioned with respect to a first and second device for moving sheets received from the first device to the second device, comprising:

a sheet support surface;

a registration edge positioned at one edge of said sheet support surface for registering sheets individually;

a belt-on-belt sheet transport for transporting the sheets received from the first device into said registration edge, said belt-on-belt sheet transport including only superposed belts;

means for corrugating each sheet as it is driven by said belt-on-belt transport; and feed rolls activated for one revolution after each sheet is registered against said registration edge in order to feed each sheet into the second device.

* * * * *